US007140988B1

(12) United States Patent
Hinman

(10) Patent No.: US 7,140,988 B1
(45) Date of Patent: Nov. 28, 2006

(54) BAT WITH INTERCHANGEABLE HANDLE AND BARREL

(75) Inventor: Rod G. Hinman, West Falls, NY (US)

(73) Assignee: Rawlings Sporting Goods Company, Inc., St. Louis, MO (US)

( * ) Notice: Subject to any disclaimer, the term of this patent is extended or adjusted under 35 U.S.C. 154(b) by 0 days.

(21) Appl. No.: 10/914,844

(22) Filed: Aug. 10, 2004

(51) Int. Cl.
*A63B 59/06* (2006.01)

(52) U.S. Cl. ..... 473/566; 473/567; 473/564

(58) Field of Classification Search ..... 473/564–568, 473/457, 519, 520
See application file for complete search history.

(56) References Cited

U.S. PATENT DOCUMENTS

| | | | | | |
|---|---|---|---|---|---|
| 1,603,904 | A | * | 10/1926 | Cohn | 473/519 |
| 1,665,195 | A | * | 4/1928 | Cohn | 473/520 |
| 3,578,801 | A | * | 5/1971 | Piazza | 473/457 |
| 3,877,698 | A | | 4/1975 | Volpe | 273/72 |
| 3,955,816 | A | | 5/1976 | Bratt | 373/26 |
| 3,963,239 | A | | 6/1976 | Fujii | 273/72 |
| 4,274,631 | A | * | 6/1981 | Hayazaki | 473/457 |
| 4,600,193 | A | | 7/1986 | Merritt | 273/72 |
| 4,819,935 | A | | 4/1989 | Dirksing et al. | 272/124 |
| 4,907,800 | A | | 3/1990 | Passamaneck et al. | 273/26 |
| 4,951,948 | A | * | 8/1990 | Peng | 473/520 |
| 5,219,164 | A | | 6/1993 | Peng | 273/72 |
| 5,364,095 | A | | 11/1994 | Easton et al. | 273/72 |
| 5,409,214 | A | | 4/1995 | Cook | 273/72 |
| 5,415,398 | A | | 5/1995 | Eggiman | 273/72 |
| 5,820,438 | A | | 10/1998 | Horton, III | 446/213 |
| 6,334,825 | B1 | * | 1/2002 | Buiatti | 473/566 |
| 6,432,006 | B1 | | 8/2002 | Tribble | 473/564 |
| 6,440,017 | B1 | * | 8/2002 | Anderson | 473/566 |
| 6,511,392 | B1 | | 1/2003 | Chohan | 473/564 |
| 6,530,852 | B1 | * | 3/2003 | Rios | 473/566 |
| 6,612,945 | B1 | * | 9/2003 | Anderson | 473/566 |
| 6,875,137 | B1 | * | 4/2005 | Forsythe et al. | 473/566 |
| 2002/0072436 | A1 | * | 6/2002 | Liu | 473/457 |
| 2003/0069095 | A1 | | 4/2003 | Turos | |
| 2003/0144089 | A1 | | 7/2003 | Ryan | |

OTHER PUBLICATIONS

Foreign translation of Bat and Forming Method Thereof 6-91026.
Worth America's Baseball/Softball Company 1990/1991 Catalog.

* cited by examiner

*Primary Examiner*—Mark S. Graham
(74) *Attorney, Agent, or Firm*—Waddey & Patterson, P.C.; Edward D. Lanquist, Jr; Phillip E. Walker

(57) ABSTRACT

The present invention discloses a bat having an interchangeable handle portion and barrel portion. The handle portion has a first end and a second end. The barrel portion has a proximal end and a distal end, the proximal end abuttable to the second end of the handle portion. A tie rod received by the handle portion and the barrel portion, the tie rod having an alpha end and a beta end, the alpha end placible proximal the first end of the handle. An end cap placible proximal the distal end, the end cap releasibly attached to the beta end of the tie rod.

6 Claims, 1 Drawing Sheet

BAT WITH INTERCHANGEABLE HANDLE AND BARREL

Be it known that 1, Rod G. Hinman, a citizen of the United States, residing at 9732 Darien Road, West Falls, N.Y. 14170-9647; have invented a new and useful "Bat with Interchangeable Handle and Barrel."

A portion of the disclosure of this patent document contains material that is subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

BACKGROUND OF THE INVENTION

The present invention relates generally to an implement used for playing diamond sport and, more particularly, to a bat with interchangeable handles and barrels.

It will be appreciated by those of ordinary skill in the art that in the diamond sports, high performance bats are desired. It will further be appreciated that high performance bats also come at a considerable price. It will also be appreciated that the best bat for a particular person depends upon the weight of the bat, the length of the bat, how the weight is distributed, the material from which the bat is made, whether it is a single wall or shell bat, and other factors. Further, the best bat for an individual at bat varies based upon the type of ball used, the desired optimal result of the bat, the temperature, and other factors. This causes an individual player to own many bats and teams to own many more bats. Different softball associations require bats to meet different performance standards. Further, players like to use one bat for batting practice and another bat for game situations.

Further, it should be appreciated by one of ordinary skill in the art that different parts of a bat wear out for different reasons and at different times. For example, the barrel or ball striking portion of the bat tends to deflect when contacting the ball. Over time, this repeated deflection creates deformations. These deformations cause failure. As a result, the barrel on a bat may fail leaving the handle functional. To this end there have certain attempts to provide separate handle and barrels. Unfortunately, these separatable bats adversely effect the performance of the bat.

US Patent Application Publication No. US 2003/0069095 filed Apr. 10, 2003 disclosed a handle threadibly attached to a taper section and threadibly attached to a barrel section. Unfortunately, this direct threadible attachment creates many issues. Initially, the threaded portions will be the weakest sections of the fixed beam resulting in failure at the threaded portions. Likewise, U.S. Pat. No. 5,409,214; U.S. Pat. No. 6,511,392; U.S. Pat. No. 6,432,006; U.S. Pat. No. 5,820,438; U.S. Pat. No. 4,907,800; and U.S. Pat. No. 3,955,816 disclose pieces that are threadibly attached together or attached with very short threaded dowels or bolts. Other inventions such as those disclosed in Pub. No. US2003/0144089 and U.S. Pat. No. 4,819,935 use an internally threaded spine to hold the pieces together or to adjust the positions of the various pieces. U.S. Pat. No. 3,877,698 uses an internal dowel with grooves. In each of these cited patents and published applications, the inventor uses internal threading. This is difficult to achieve and adds much cost to the product. Further, the combined threads are likely to wear our over time. More importantly, none of these configurations appear to be useable in connection with a bat having a shell.

What is needed then is a bat with interchangeable handle and barrel. This needed bat allows the user to rapidly change handles, tapers, and barrels. This needed bat must allow the user to insert an exterior shell if necessary. This needed bat must allow the user to change the components of the bat to use varying materials, weights, sizes, and grip. This needed bat must provide barrels capable of use in connection with different governing bodies having different standards. This needed bat must be capable of use in connection with different bats for different purposes such as batting practice and game situations. This bat is presently lacking in the prior art.

BRIEF SUMMARY OF THE INVENTION

The present invention discloses a bat having an interchangeable handle portion and barrel portion. The handle portion has a first end and a second end. The barrel portion has a proximal end and a distal end, the proximal end abuttable to the second end of the handle portion. A tie rod received by the handle portion and the barrel portion, the tie rod having an alpha end and a beta end, the alpha end placeable proximal the first end of the handle. An end cap placeable proximal the distal end, the end cap releasibly attached to the beta end of the tie rod.

Accordingly, one object of the present invention is to provide a bat with an interchangeable handle.

Accordingly, one object of the present invention is to provide a bat with an interchangeable barrel.

Accordingly, one object of the present invention is to provide a bat with an interchangeable shell.

Another object of the present invention is to provide a bat that allows the user to change the handle, taper, barrel, and shell very quickly.

Another object of the present invention is to provide a bat that allows the user to substitute parts that may wear out over time.

Another object of the present invention is to provide a bat that is inexpensive to make.

DETAILED DESCRIPTION OF THE INVENTION

Figure 1:
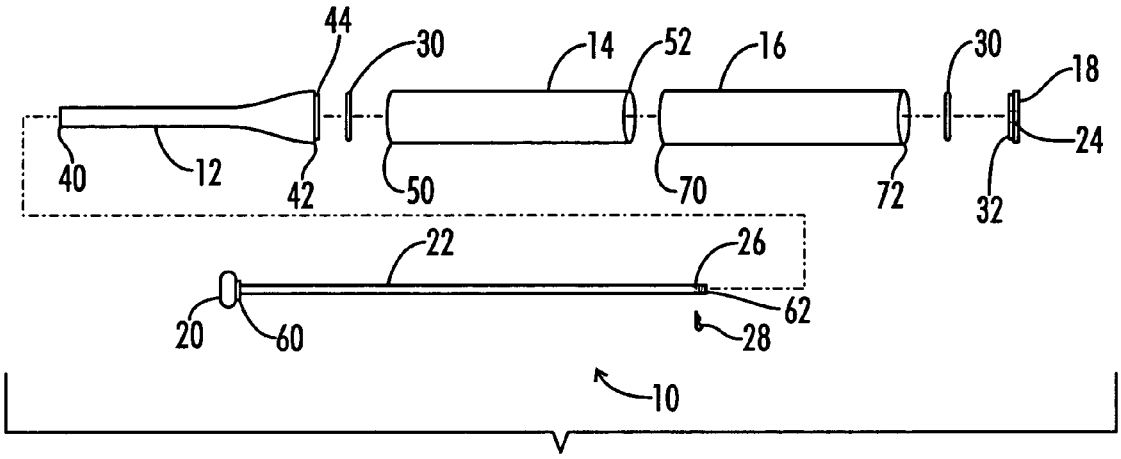
FIG. 1 is an exploded view of the preferred embodiment of the present invention.
Figure 2:
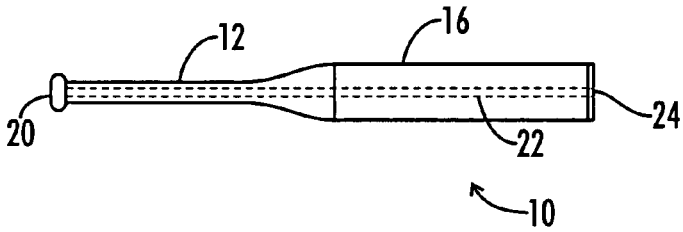
FIG. 2 is a side view of the preferred embodiment of the present invention.

Referring now to FIGS. 1–2 there is shown generally at 10, the preferred embodiment of the bat with interchangeable handle and barrel of the present invention. The bat 10 has a handle portion 12, a barrel portion 14, an optional shell 16, and end cap 18, a knob 20, and a tie rod 22. The handle portion 12 has a first end 40 and a second end 42. In the preferred embodiment, the handle portion 12 is a hollow formed tubular item made of preferably a metal alloy such as aluminum, steel, titanium, etc. However, the handle portion 12 may be made of any other material such as composite, plastic, rubber, or wood. Preferably, handle portion has a reduced diameter portion 44 that seat into barrel portion.

The barrel portion 14 has a proximal end 50 and a distal end 52. The proximal end 50 is placed adjacent to the second end 42 of the handle portion 12. In the preferred embodiment, the barrel portion 14 is a hollow formed tubular item made of preferably a metal alloy such as aluminum, steel, titanium, etc. However, the barrel portion 14 may be made of any other material such as composite, rubber, plastic or wood.

The tie rod 22 is received by the handle portion 12 and the barrel portion 14. The tie rod 22 has an alpha end 60 and a beta end 62. The alpha end 60 is placed proximal the first end 40 of the handle 12. In the preferred embodiment, the tie rod 22 is a long, preferably round, tubular item made of preferably a metal alloy such as aluminum, steel, titanium, etc. However, the tie rod 22 may be made of any other material such as composite, plastic, rubber, or wood.

Preferably, the knob 20 is attached to the alpha end 60 of the tie rod 22. Preferably, this attachment is permanent. However, some type of releasable attachment could be used. Knob 20 could be threadibly attaghed to tie rod 22.

The end cap 18 is placed proximal the distal end 52 of the barrel portion 14. The end cap 18 is releasibly attached to the beta end 62 of the tie rod 22. Preferably, a cotter pin 28 or spring clip is placeable in an orifice 26 in the beta end 62 of the tie rod 22. The end cap 18 has a hole 24 for receiving the beta end 62 of the tie rod 22. Preferably, the end cap 18 has a tab 32 that is sized to fit inside the distal end 52 of the barrel portion 14. The end cap 18 could also be threadibly attached to the beta end 62 of the tie rod 22. Such threaded attachment would also allow the user to tighten or loosen the end cap 18 closer to the alpha end to achieve better control over the tightness of the connection with the cotter pin 28 or spring clip acting as a safety.

To better secure and join various sections, O-rings 30 are used. One O-ring 30 may be placed between the handle portion 12 and the barrel portion 14. Another O-ring 30 may be placed between the end cap 18 and the barrel portion 14. O-Rings 30 are preferably made of rubber. However, any material may be used.

The second end 42 of the handle portion 12 has a reduced diameter portion 44. The proximal end 50 receives the reduced diameter portion 44 of the second end 42. However, the proximal end 50 could also have a reduced diameter portion received by the second end 42.

The bat 10 may also include a shell 16 having a gamma end 70 and a delta end 72. The shell 16 is placed over the barrel portion 14 having its gamma end 70 proximal the second end 42 and the delta end 72 proximal the end cap 18.

To assemble the bat 10, the tie rod 22 is placed through the hollow handle portion 12 with the knob 20 abutting first end 40. An O-ring 30 is placed over the reduced diameter portion 44. The barrel portion 14 is then placed over the tie rod 22 so that the proximal end 50 abuts the second end 42 and receives all or part of the reduced diameter portion 44. An O-ring 39 is placed over the tab 32 of the end cap 18. The hole 24 of the end cap 18 is then placed over the tie rod so that the tab 32 fits into distal end 52. The cotter pin or spring clip 28 is then placed in the orifice 26 in the tie rod 22. The tie rod 22 is sized so that it firmly holds these pieces together. If the shell 16 is used, it is placed over the barrel section 14 prior to placement and securing of the end cap 18.

Thus, although there have been described particular embodiments of the present invention of a new and useful bat with interchangeable handle and barrel, it is not intended that such references be construed as limitations upon the scope of this invention except as set forth in the following claims.

What is claimed is:

1. A bat comprising:

a handle portion having a first end and a second end, the second portion expanding in diameter distal from the first end and including a reduced diameter portion positioned opposite the first end;

a barrel portion having a proximal end and a distal end, the proximal end abutted to the second end of the handle portion;

a first O-ring positioned around the reduced diameter portion, wherein the proximal end of the barrel portion internally receives the reduced diameter portion and engages the first O-ring;

a tie rod received by the handle portion and the barrel portion, the tie rod having an alpha end and a beta end, the alpha end positioned proximal the first end of the handle; and an end cap positioned proximal the distal end, the end cap releasibly attached to the beta end of the tie rod and including a tab;

a second O-ring positioned around the tab wherein the distal end of the barrel portion internally receives the tab and engages the second O-ring; and a knob attached to the alpha end of the tie rod for holding the handle portion in place on the assembled bat.

2. The bat of claim 1 further comprising:

a cotter pin;

the beta end of the tie rod having an orifice for receiving the cotter pin; and the end cap having a hole for receiving the tie rod.

3. The bat of claim 1 further comprising a shell having a gamma end and a delta end, the shell placed over the barrel portion having its gamma end proximal the second end and the delta end proximal the end cap.

4. The bat of claim 1 further comprising:

a spring clip;

the beta end of the tie rod having an orifice for receiving the spring clip; and the end cap having a hole for receiving the tie rod.

5. A bat comprising:

a one piece handle portion, the handle portion being a tubular item, the handle portion having a first end and a second end, wherein the second end expands in diameter and includes a reduced diameter portion;

a barrel portion, the barrel portion having a proximal end and a distal end, the proximal end positioned adjacent the second end, the barrel portion being a hollow formed tubular item;

a first O-ring placed between the handle portion and the barrel portion, the first O-ring position outside reduced diameter portion of the handle portion and inside the barrel portion;

a tie rod received by the handle portion and the barrel portion, the tie rod having an alpha end and a beta end, the alpha end placed proximal the first end;

a knob attached to the alpha end of the tie rod for holding the handle in place;

an end cap positioned proximal the distal end of the barrel portion, the end cap releasibly attached to the beta end of the tie rod and having a tab sized to fit inside the distal end of the barrel portion; and a second O-ring placed between the end cap and the barrel portion, the second O-ring position outside the tab and inside the barrel portion.

6. The bat of claim 5 further comprising:

a cotter pin positioned in an orifice in the beta end of the tie rod;

the end cap having a hole for receiving the beta end of the tie rod.

* * * * *